US008045726B2

(12) United States Patent
Kimura

(10) Patent No.: US 8,045,726 B2
(45) Date of Patent: Oct. 25, 2011

(54) NOISE-CANCELLING HEADPHONE

(75) Inventor: Tominori Kimura, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 407 days.

(21) Appl. No.: 12/412,023

(22) Filed: Mar. 26, 2009

(65) Prior Publication Data

US 2009/0285408 A1 Nov. 19, 2009

(30) Foreign Application Priority Data

May 15, 2008 (JP) ..... 2008-128707

(51) Int. Cl.
*G10K 11/16* (2006.01)

(52) U.S. Cl. ..... 381/71.6; 381/71.1; 381/72; 381/74

(58) Field of Classification Search ..... 381/71.6, 381/71.1, 72, 74
See application file for complete search history.

(56) References Cited

U.S. PATENT DOCUMENTS

| | | | | |
|---|---|---|---|---|
| 4,132,861 | A * | 1/1979 | Frieder et al. | 381/335 |
| 5,774,565 | A * | 6/1998 | Benning et al. | 381/83 |
| 6,567,655 | B1 * | 5/2003 | Wietzke et al. | 455/345 |
| 7,460,676 | B2 * | 12/2008 | Morimoto | 381/74 |
| 7,742,610 | B1 * | 6/2010 | Hibino et al. | 381/74 |
| 7,822,400 | B1 * | 10/2010 | Son | 455/296 |
| 7,876,911 | B2 * | 1/2011 | Felder et al. | 381/74 |
| 2001/0046304 | A1 * | 11/2001 | Rast | 381/74 |
| 2005/0213773 | A1 * | 9/2005 | Donaldson et al. | 381/71.6 |
| 2008/0175402 | A1 * | 7/2008 | Abe et al. | 381/71.6 |
| 2009/0225999 | A1 * | 9/2009 | Lee | 381/74 |
| 2009/0285408 | A1 * | 11/2009 | Kimura | 381/71.6 |
| 2010/0166206 | A1 * | 7/2010 | Macours | 381/71.6 |
| 2011/0002476 | A1 * | 1/2011 | Morishima et al. | 381/71.6 |
| 2011/0033060 | A1 * | 2/2011 | Johnson et al. | 381/71.6 |

FOREIGN PATENT DOCUMENTS

| | | | |
|---|---|---|---|
| JP | 2004-526375 | A | 8/2004 |
| WO | 02/082422 | A2 | 10/2002 |

* cited by examiner

*Primary Examiner* — Elvin G Enad
*Assistant Examiner* — Robert W Horn
(74) *Attorney, Agent, or Firm* — Sughrue Mion, PLLC

(57) ABSTRACT

A noise-cancelling headphone includes a cancel signal generator that receives ambient noise via an electro-acoustic transducer and generates and outputs a cancel signal eliminating the noise and a speaker unit that outputs an audio signal and a cancel signal, and connects the cancel signal generator to a first terminal of two input terminals of the speaker unit and connects a sound source of an audio signal to a second terminal thereof, whereby obtaining the noise-cancelling headphone with which one can enjoy music with high quality without the change in the sound quality and volume between when a noise-cancelling function is activated and when deactivated.

14 Claims, 11 Drawing Sheets

NOISE-CANCELLING HEADPHONE

BACKGROUND OF THE INVENTION

1. Field of the Invention

The present invention relates to a noise-cancelling headphone with which one can enjoy music without being hindered by ambient noise by outputting a signal that cancels the ambient noise along with an audio signal and, more particularly, to a noise-cancelling headphone with which one can enjoy music with high sound quality without the change in sound quality and volume between when a noise-cancelling function is activated and when it is deactivated.

2. Description of the Related Art

A noise-cancelling headphone is desired, with which one can listen to music with high sound quality while cancelling ambient noise. In general, a noise-cancelling headphone has a microphone that picks up ambient noise to a headphone case etc., a cancel signal generation circuit that generates a signal (cancel signal) cancelling noise heard by the ears through the headphone case from the noise picked up by the microphone, and a mixer circuit that combines a music signal with a cancel signal and outputs the combined signal. When such a noise-cancelling headphone is used, if sounds informing of the surrounding circumstances (for example, sirens or horns) are cancelled by a cancel signal, there is a possibility that the safety of a headphone user is compromised. Consequently, a noise-cancelling headphone is known, which can be used comfortably while ensuring the safety of a user by selectively separating the "sounds informing of the surrounding circumstances" as "sounds interesting for the user" in consideration of the safety of a user and by generating no cancel signal against the "sounds interesting for the user" while generating a cancel signal against other sounds (ambient noises picked up by a sound pickup microphone) (for example, refer to patent document 1).

[Prior art document]

[Patent document 1] No. JP 2004-526375 W

SUMMARY OF THE INVENTION

A noise-cancelling headphone is also known, which uses a conventional noise-cancelling headphone represented by such a noise-cancelling headphone described in the above-mentioned document and with which one can listen to only music without the need to activate a noise-cancelling function. In such a noise-cancelling headphone capable of switching operations, the operation of a cancel signal generation circuit is turned on/off with a switch. When the operation of the cancel signal generation circuit is turned on/off, the input of a mixer circuit is turned on/off as a result, and therefore, the characteristics of its output signal largely depend on the operation of the cancel signal generation circuit. That is, when the operation is off, the sound volume of an audio signal is reduced or the sound quality is degraded, and audio signal becomes another one different from the original one.

There is also a noise-cancelling headphone that stops outputting of music when the noise-cancelling function is deactivated so that the user does not become aware of the change in the sound volume and sound quality of reproduced sounds caused by the deactivation of the noise-cancelling function.

Further, among those which do not deactivate the noise-cancelling function, there is also known a noise-cancelling headphone in which its headphone speaker unit itself is designed so as to be capable of easily exhibiting a noise-cancelling effect and so that the sound quality hardly changes depending on the operating state in order to avoid the above-mentioned change in the sound quality and volume. However, such a noise-cancelling headphone deviates from the original concept of the headphone: an audio signal output from a sound source should be reproduced faithfully, and therefore, excellent reproduced sound quality cannot be obtained.

As described above, a conventional noise-cancelling headphone has a problem that the sound quality and volume of an audio signal change depending on its operating mode and a reproduced sound with quality desired by a user cannot be obtained.

The present invention has been developed in view of the above-mentioned problem and has an object to provide a noise-cancelling headphone capable of outputting a reproduced sound without changing the characteristics of a n regardless whether or not a noise-cancelling function is in operation and also of activating only the noise-cancelling function without inputting an audio signal.

An aspect of the present invention is a noise-cancelling headphone comprising an electro-acoustic transducer converting ambient noise into a noise signal; a cancel signal generator generating and outputting a cancel signal to eliminate the noise from the noise signal; and a speaker unit outputting an audio signal and the cancel signal, wherein the cancel signal generator is connected to a first terminal of two input terminals of the speaker unit and a sound source of the audio signal is connected to a second terminal.

The noise-cancelling headphone may further comprise a first switching unit between the first terminal of the speaker unit and the cancel signal generator and the first switching unit may be capable of selecting either to connect the cancel signal generator to the first terminal or to ground the first terminal.

The first switching unit may be composed of a selector switch having a movable contact and a first fixed contact and a second fixed contact selected by the movable contact, and the movable contact may be connected to the first terminal of the speaker, the first fixed contact may be connected to the cancel signal generator, and the second fixed contact may be grounded.

The noise-cancelling headphone may further comprise an audio signal detector detecting the audio signal input from the sound source and outputting a control signal; a second selector switch located between a sound source input terminal and the audio signal detector and working with a first selector switch; a first electronic switch making a contact by the control signal of the audio signal detector; and a second electronic switch breaking a contact by the control signal of the audio signal detector, and it may be also possible to configure such that a movable contact of the second selector switch is connected to the sound source input terminal, a first fixed contact is connected to the audio signal detector, and a second fixed contact bypasses the first electronic switch and is connected to the second terminal of the speaker unit; and the first electronic switch is connected to the sound source input terminal and the second terminal of the speaker unit, and the second electronic switch is connected between the second terminal of the speaker unit and the ground.

The noise-cancelling headphone may further comprise a sound source input terminal capable of attaching/detaching the sound source; a headphone amplifier outputting the audio signal input from the sound source; and a third switching unit between the second terminal of the speaker unit and the headphone amplifier, and between the second terminal of the speaker unit and the sound source input terminal, and it may also be possible to configure so that the third switching unit can select to connect to the second terminal of the speaker unit either the headphone amplifier or the sound source input terminal.

According to the present invention, since a noise-cancelling function is realized by independently outputting an audio signal and a noise-cancelling signal, respectively, from a speaker unit without electrically combining them in a mixer circuit, it is possible to obtain a noise-cancelling headphone capable of cancelling ambient noise while maintaining the original high sound quality desired by users.

Further, according to the present invention, it is possible to obtain a noise-cancelling headphone capable of selectively changing to an optimum circuit configuration automatically by detecting the presence/absence of an audio signal.

DESCRIPTION OF THE PREFERRED EMBODIMENTS

Figure 1:
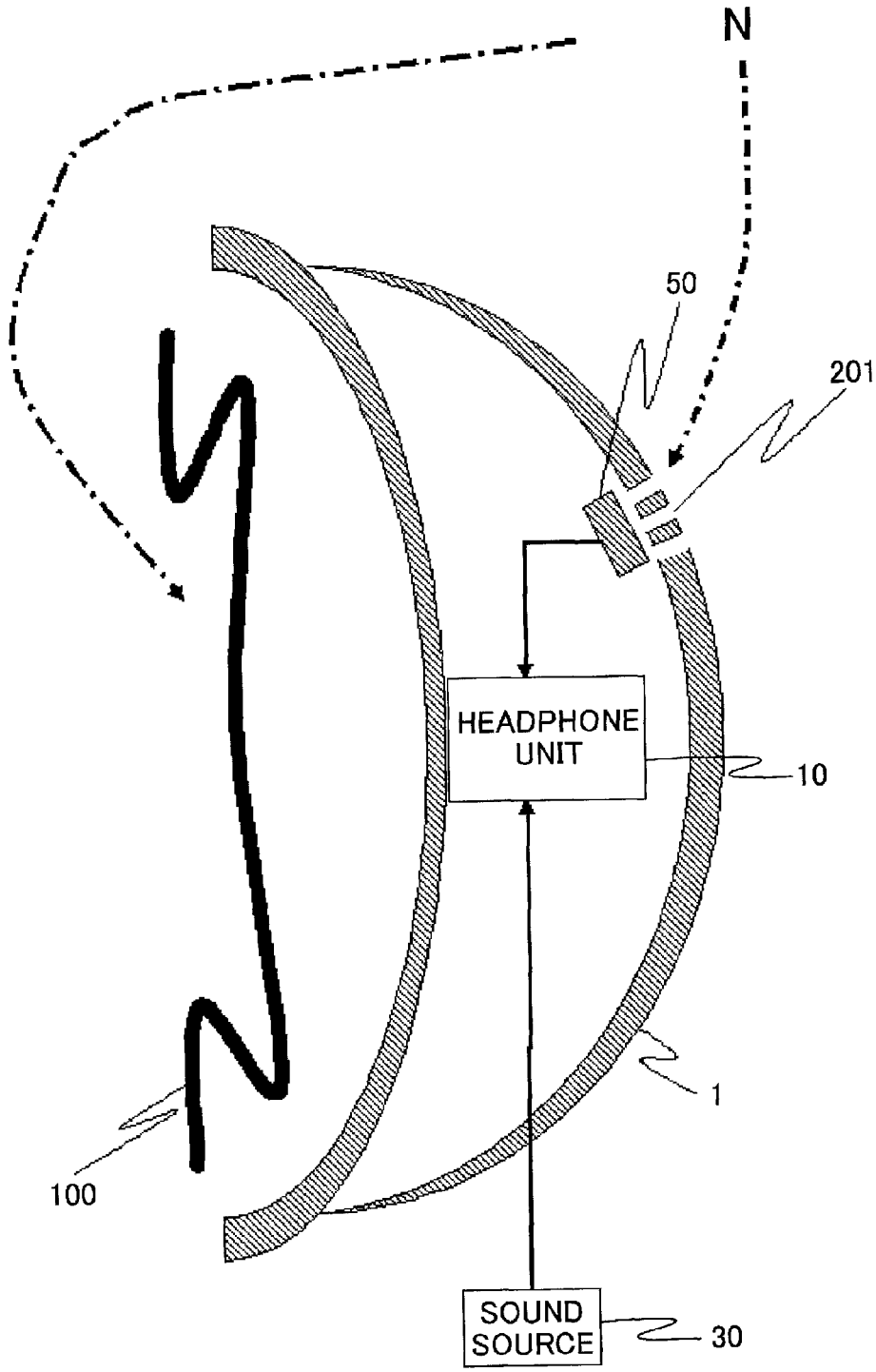
FIG. 1 is a section view showing an outline of an embodiment of a noise-cancelling headphone according to the present invention by only a case of one side.

An embodiment of a noise-cancelling headphone according to the present invention will be described using the drawings. FIG. 1 is a schematic diagram showing only a case of one side of a noise-cancelling headphone composed of a pair of right and left parts. In FIG. 1, inside a headphone case 1, a headphone unit 10 and a microphone unit 50 that picks up ambient noise N are incorporated. The headphone unit 10 includes a speaker unit and a cancel signal generation part that generates a signal to cancel the noise N from a noise signal picked up by the microphone unit 50 and converted into an electric signal, as will be described later. A part of an outer wall of the headphone case 1 is provided with a through-hole 201 that helps the microphone unit 50 in picking up the noise N and the microphone unit 50 is incorporated inside the through-hole 201 facing outward. It is possible to connect a sound source 30, such as a portable music player, to the headphone unit 10. By inputting an audio signal input from the sound source 30 and a signal to cancel the noise to the headphone unit 10, a sound wave based on the n and the cancel signal is generated from the headphone unit 10 and output to ears 100 of a user. The phase of the noise N that enters the case 1 and the phase of the sound wave output from the headphone unit 10 based on the cancel signal are opposite to each other, and therefore, the noise N is cancelled and the user can listen to only music. The headphone case 1 also contains a battery, not shown, which is a drive power source of the headphone unit 10.

The noise-cancelling headphone is realized by comprising the headphone case 1 having the above-mentioned configuration on both the right side and the left side. It is possible to operate the headphone cases 1 on both the right side and the left side as a pair of right and left noise-cancelling headphones by routing a wire to input an audio signal into the cases 1 on both the right side and the left side, respectively, or routing a wire to input an audio signal into one of the headphone cases 1 and providing a wire that transmits the audio signal from the case 1 to the other case 1.

Figure 2:
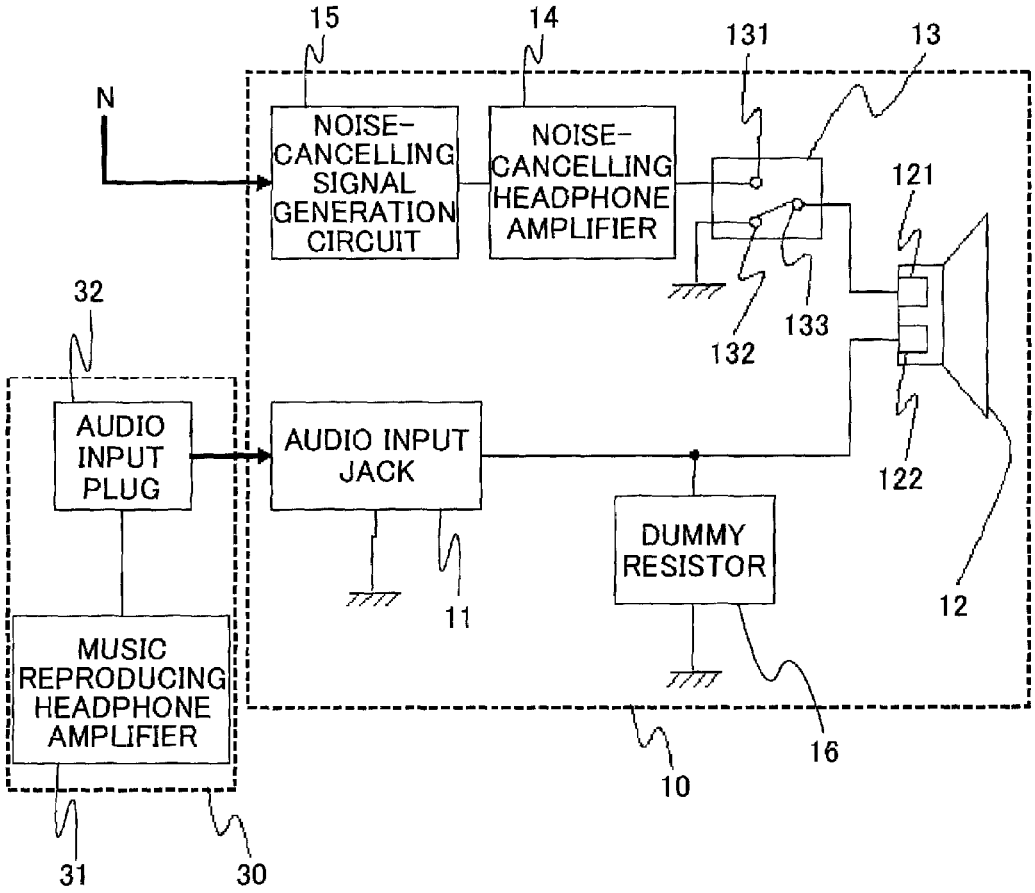
FIG. 2 is a block diagram showing an example of a noise-cancelling circuit comprised by the noise-cancelling headphone.

Details of the headphone unit 10 will be described using a block diagram in FIG. 2. In FIG. 2, the headphone unit 10 has a speaker unit 12 having two input terminals, a selector switch 13 that switches a circuit to be connected to one terminal 121 of the speaker unit 12 to another, a noise-cancelling headphone amplifier 14 that connects to the terminal 121 via the selector switch 13, and a noise-cancelling signal generation circuit 15 that generates a cancel signal that cancels the noise N picked up by the microphone 50 and outputs it to the noise-cancelling headphone 14, and further having an audio input jack 11, which is an interface that connects the sound source 30 to the other terminal 122 of the speaker unit 12 and a dummy resistor 16 having a resistance value larger than the output impedance of the sound source 30 and smaller than the impedance of the speaker unit 12.

The noise-cancelling headphone amplifier 14 drives the speaker unit 12 by a noise-cancelling signal. The sound source 30 that inputs an audio signal to the headphone unit 10 has a music reproducer, not shown, which reproduces an audio signal to be input to the headphone unit 10, and further having a music reproducing headphone amplifier 31 that performs predetermined processing, such as amplification, on the reproduced audio signal and outputs it, and an audio input plug 32 that outputs the audio signal output from the music reproducing headphone amplifier 31 toward the headphone unit 10. It is possible to connect the audio input plug 32 to the audio input jack 11 provided on the side of the headphone unit 10 and it is designed so that the audio signal from the sound source 30 is input to the terminal 122 of the speaker unit 12 by connecting the plug 32 to the jack 11. The audio input jack 11 is configured so that the terminal on the signal side of the jack 11, that is, the terminal 122 of the speaker unit 12 is grounded when the audio input plug 32 is pulled out of the jack 11.

The selector switch 13 is a switch that turns on/off the noise-cancelling processing in the headphone unit 10. The selector switch 13 shown in FIG. 2 has two fixed contacts and one movable contact. A movable contact 133 of the switch 13 is connected to the terminal 121, one of the terminals of the speaker unit 12, and to one fixed contact 131, the noise-cancelling headphone amplifier 14 is connected and the other fixed contact 132 is grounded. Consequently, it is possible to select and switch either to connect the noise-cancelling headphone amplifier 14 to the terminal 121 of the speaker unit 12 or to ground the terminal 121 using the selector switch 13. The selector switch 13 may be one capable of being used also as a power source switch of the noise-cancelling headphone or may further have a contact to switch connections between a drive power source, not shown, and each circuit. For example, it is designed so that when the movable contact 133 is on the side of the fixed contact 132, the power source switch of the noise-cancelling headphone is turned off.

To the other terminal 122 of the speaker unit 12, the sound source 30 is connected via the audio input jack 11 and thus an audio signal is input. The terminal 122 is grounded via the dummy resistor 16 having a resistance value larger than the output impedance of the sound source 30 and smaller than the impedance of the speaker unit 12. The resistance value of the dummy resistor 16 is set to a value higher than the output impedance of the music reproducing headphone amplifier 31. For example, the output impedance of the music reproducing headphone amplifier 31 is normally between about 0.5 to 1Ω, and therefore, it is only required for the dummy resistor 16 to have a resistance value of about, for example, over ten Ω.

Figure 3:
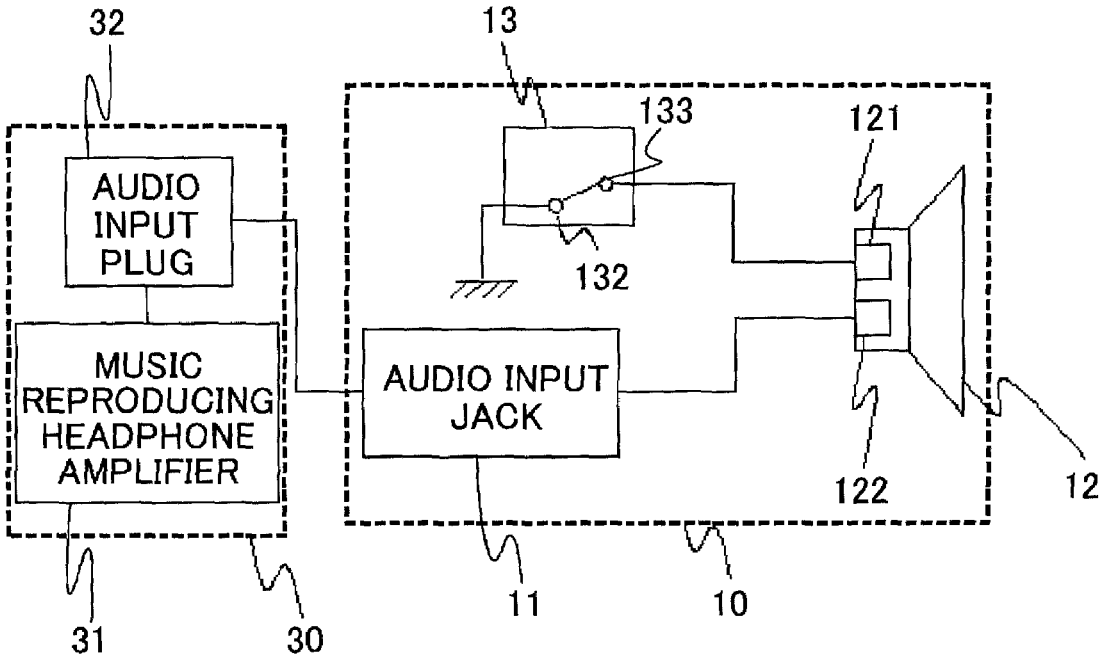
FIG. 3 is a block diagram showing an example of an operating state of the noise-cancelling circuit.

Next, the operation of the headphone unit 10 will be described. FIG. 3 is a block diagram equivalently showing a state where the noise-cancelling operation is deactivated. As shown in FIG. 3, because the movable contact 133 of the selector switch 13 is on the side of the fixed contact 132, the terminal 121 of the speaker unit 12 is brought into a state where it is grounded via the selector switch 13. To the other terminal 122, the sound source 30 is connected via the audio input jack 11, and therefore, a state is brought about where the speaker unit 12 is driven by an audio signal input from the sound source 30, that is, the same state as that of the normal headphone. It is possible for a user to listen to music in a state where the noise-cancelling function is deactivated.

The output impedance of the noise-cancelling headphone amplifier 14 is between about 0.5 to 1Ω like the output impedance of the music reproducing headphone amplifier 31. Consequently, when viewed from the terminal 121 of the speaker unit 12, there is no significant difference whether the terminal 121 is connected to the noise-cancelling headphone amplifier 14 or grounded. Because of this, even when the noise-cancelling function is deactivated, it is possible to output music without affecting the sound quality and volume of an audio signal and to listen to music with high quality even with a noise-cancelling headphone in the same way as that with a normal headphone.

Figure 4:
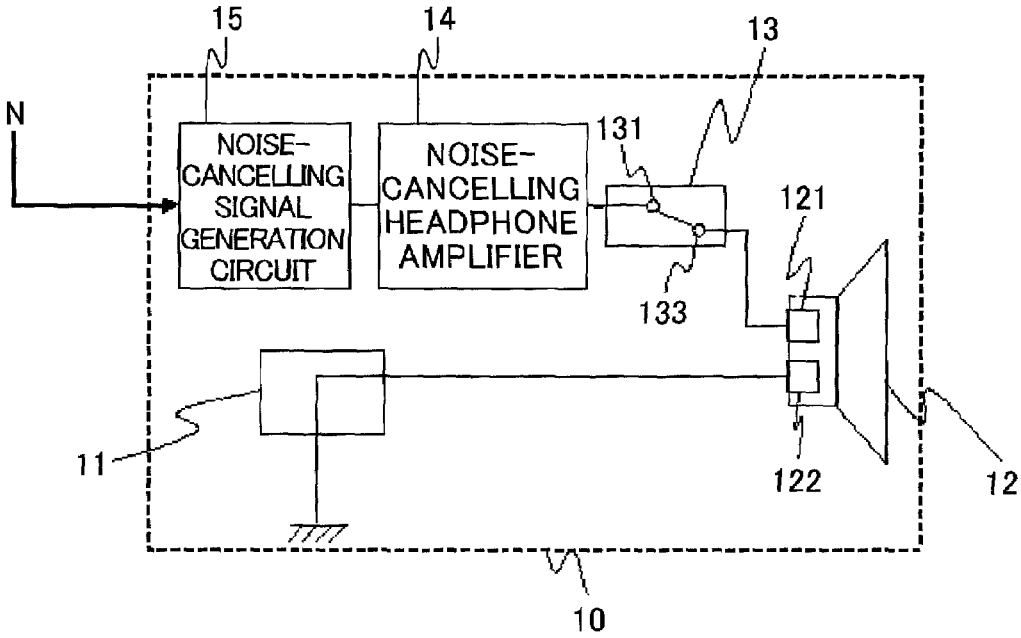
FIG. 4 is a block diagram showing an example of another operating state of the noise-cancelling circuit.

FIG. 4 is a block diagram equivalently showing a state where the noise-cancelling operation is performed by switching the selector switch 13 to the side of the fixed contact 131 and the audio input plug 32 of the sound source 30 is pulled out of the audio input jack 11 in the headphone unit 10. As already described, the audio input jack 11 has a structure in which the signal side terminal is grounded when the audio input plug 32 is not inserted, and therefore, the second terminal 122 of the speaker unit 12 is grounded via the audio input jack 11, as a result. To the first terminal 121 of the speaker unit 12, the noise-cancelling signal generation circuit 15 is connected via the noise-cancelling headphone amplifier 14, and therefore, the speaker unit 12 is driven only by a cancel signal generated from the noise N picked up by the microphone unit 50, as shown in FIG. 1. As already described, the output impedance of the music reproducing headphone amplifier 31 is normally between about 0.5 to 1 Ω, and therefore, there is no significant difference even if it is grounded via the audio input jack 11 when viewed from the terminal 122. Consequently, even when only the noise-cancelling function is enabled for use without the sound source 30 connected, it is possible to use it as a headphone dedicated to noise cancellation that exhibits a high noise-cancelling effect.

The noise-cancelling headphone that uses the headphone unit 10 can be used as a headphone dedicated to the noise-cancelling function by switching the selector switch 13 to the noise-cancelling headphone amplifier 14 and not connecting the sound source 30. When it is used as a headphone for music only by switching the selector switch 13 to the installation side to deactivate the noise-cancelling function, the output impedance of the music reproducing headphone amplifier 31 is substantially the same as the impedance of the grounded terminal 122 of the speaker unit 12. As a result, it is possible to listen to music with high sound quality regardless whether or not the noise-cancelling function is used.

Figure 5:
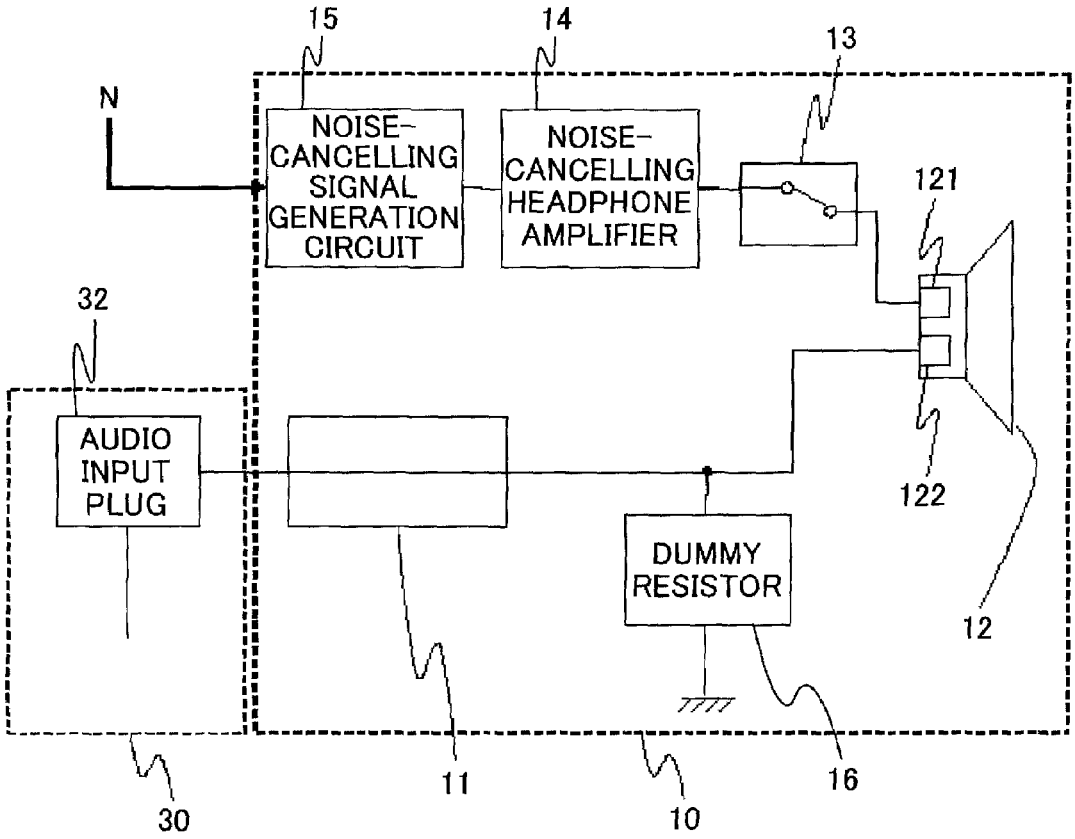
FIG. 5 is a block diagram showing an example of still another operating state of the noise-cancelling circuit.

FIG. 5 is a block diagram equivalently showing a state where the plug on the side of the music reproducing headphone amplifier 31 is pulled out unlike the aspect shown in FIG. 4 where the audio input plug 32 of the sound source 30 is pulled out of the audio input jack 11. The general sound source 30 is provided with an input jack into which the audio input plug 32 can be inserted also on the side of the music reproducing headphone amplifier 31. Consequently, there is a case where the audio input plug 32 is pulled out from the input jack on the side of the music reproducing headphone amplifier 31, not from the audio input jack 11.

As already described, when the audio input plug 32 is inserted into the jack 11, the terminal 122 is not grounded by the audio input jack 11 but floats from the ground by the other terminal of the audio input plug 32. If this state continues, the speaker unit 12 enters a high impedance state when viewed from the noise-cancelling headphone amplifier 14, and therefore, it is not possible to drive the speaker unit 12 by the headphone amplifier 14. Consequently, as shown in FIG. 5, the dummy resistor 16 is connected in advance between the terminal 122 and the ground. When the connection with the music reproducing headphone amplifier 31 is cut with the audio input plug 32 left inserted, the dummy resistor 16 acts effectively and the terminal 122 is grounded by the dummy resistor 16, and whereby it is possible to drive the speaker unit 12 only by the noise-cancelling headphone amplifier 14 and only the noise-cancelling operation can be performed.

The resistance value of the dummy resistor 16 is set to a value larger than the output impedance of the music reproducing headphone amplifier 31 and smaller than the impedance of the speaker unit 12. Because of this, when the music reproducing headphone amplifier 31 is connected, the influence of the grounding by the dummy resistor 16 on the terminal 122 is small and it is almost unlikely that the dummy resistor 16 affects the operation of the headphone unit 10 during the normal reproduction of music. Consequently, according to the noise-cancelling headphone of the embodiment described above, it is possible to use the headphone as one that exhibits only the noise-cancelling function even when the music reproducing headphone amplifier 31 is pulled out.

As described above, in the noise-cancelling headphone according to the present embodiment, due to the music reproducing headphone amplifier 31 and the noise-cancelling headphone amplifier 14, it is possible to drive the speaker unit 12 independently by an audio signal and a cancel signal, respectively, like a bridged transformer less (BTL) amplifier, and therefore, it is possible to listen to only music with high sound quality while cancelling the noise N by simultaneously outputting an audio signal and a noise-cancelling signal.

Figure 6:
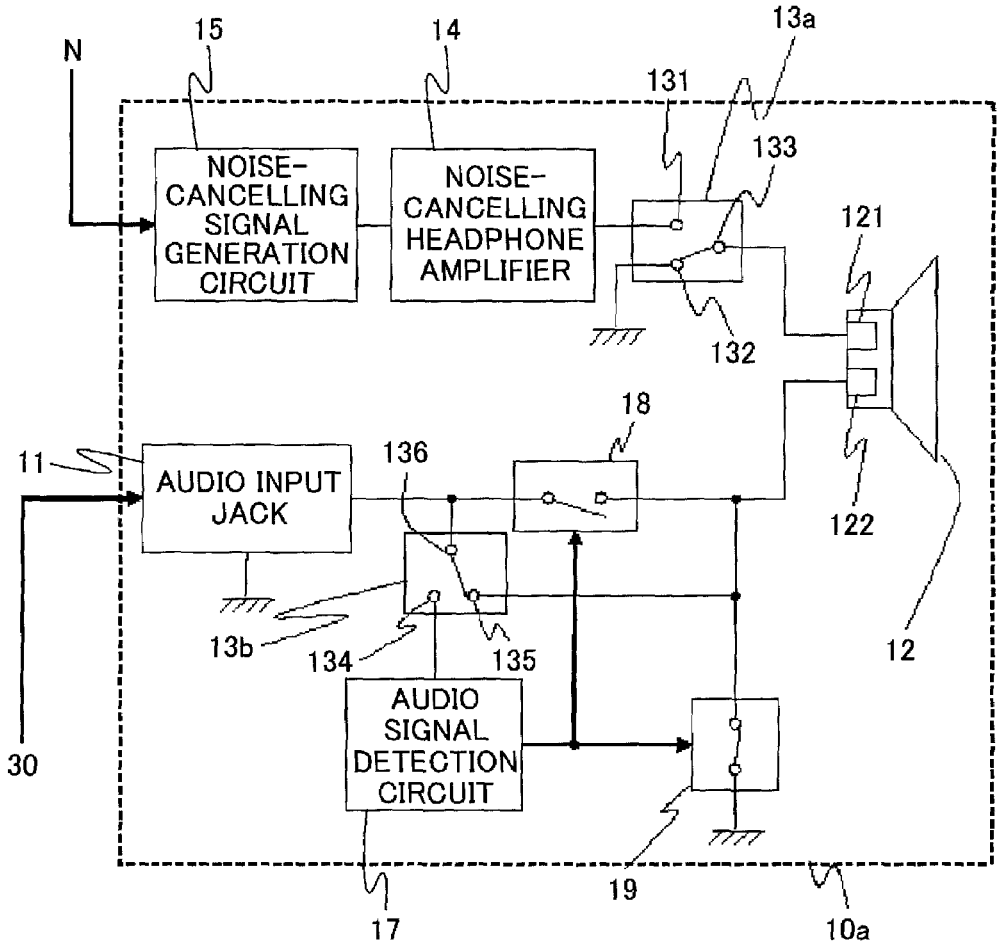
FIG. 6 is a block diagram showing another example of a noise-cancelling circuit comprised by the noise-cancelling headphone according to the present invention.

Next, another example of a headphone unit that can be used as a noise-cancelling headphone according to the present invention will be described using a functional block diagram in FIG. 6. In FIG. 6, the same symbols are used for the same constituent parts as those in the already described headphone unit 10. A headphone unit 10*a* has the speaker unit 12 having two input terminals. A circuit configuration to be connected to the terminal 121, one of terminals of the speaker unit 12, is the same as that of the headphone unit 10. A circuit configuration to be connected to the other terminal 122 is different from that of the headphone unit 10. The second terminal 122 of the speaker unit 12 in the headphone unit 10*a* has, between the audio input jack 11 and itself, an audio signal detection circuit 17 that controls two electronic switches by detecting the input of an audio signal, an electronic switch 18 that opens a contact according to an instruction from the audio signal detection circuit 17, an electronic switch 19 that closes a contact according to an instruction from the audio signal detection circuit 17, and a selector switch 13*b* that switches circuits to be connected to the terminal 122.

In the selector switch 13*b*, a movable contact 136 is connected to the audio input jack 11 and a first fixed contact 134 is connected to the audio signal detection circuit 17. A second fixed contact 135 of the selector switch 13*b* is connected to a wire that bypasses the electronic switch 18. The selector switch 13*b* is a switch that works with a selector switch 13*a* and when the movable contact 133 of the selector switch 13*a* is on the side of the fixed contact 132, the movable contact 136 of the selector switch 13*b* is on the side of the fixed contact 135. When the movable contact 133 of the selector switch 13*a* is on the side of the fixed contact 131, the movable contact 136 of the selector switch 13*b* is connected to the side of the fixed contact 134.

The selector switch 13*a* may be one which can also be used as the power source switch of the noise-cancelling headphone and may further have a contact to switch connections between a drive power source, not shown, and each circuit. In the present embodiment, the circuit is configured so that when the movable contact of the selector switch 13*a* is on the side of the second fixed contact, the power source switch is turned OFF.

Figure 7:
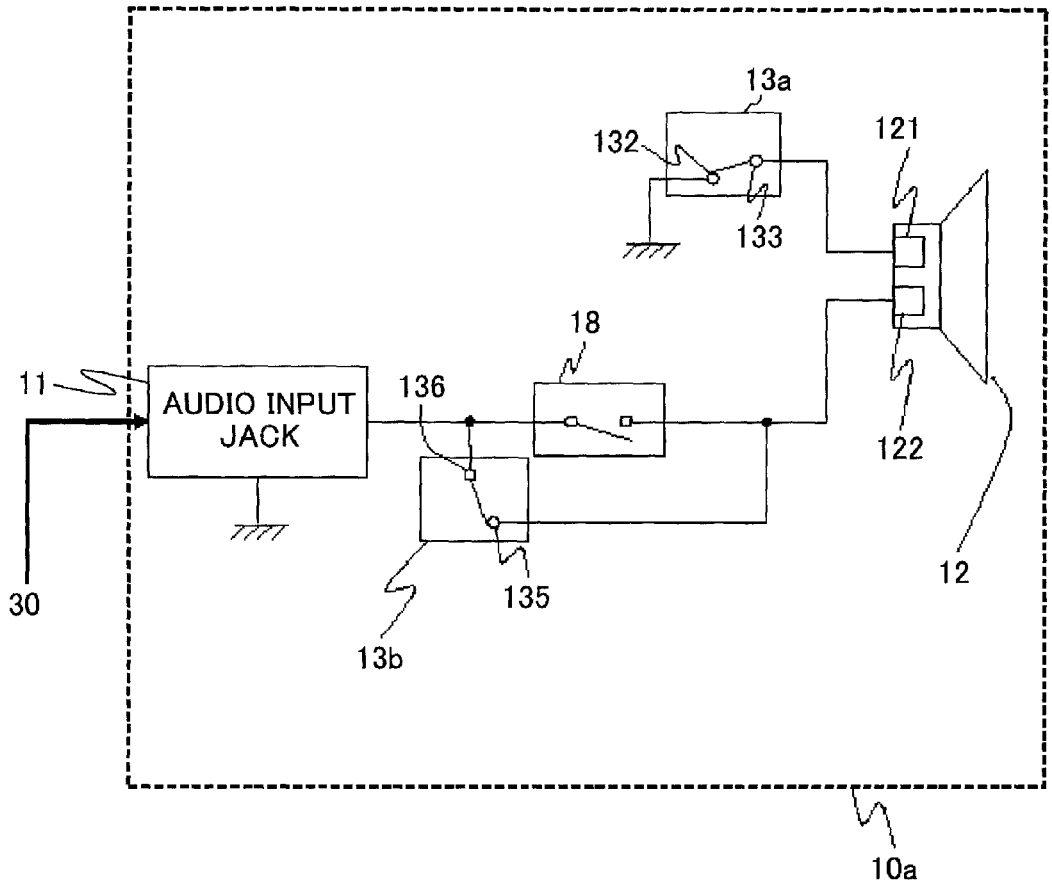
FIG. 7 is a block diagram showing an example of an operating state of the noise-cancelling circuit.

The operation of the headphone unit 10*a* will be described. FIG. 7 is a block diagram showing a state where the movable contact 133 of the selector switch 13*a* is on the side of the fixed contact 132. As shown in FIG. 7, the first terminal 121 of the speaker unit 12 is grounded and the second terminal 122 is connected to the audio input jack 11 by the wire that bypasses the electronic switch 18. Consequently, the speaker unit 12 is driven by an audio signal input from the sound source 30 and thereby a user can listen to music.

Figure 8:
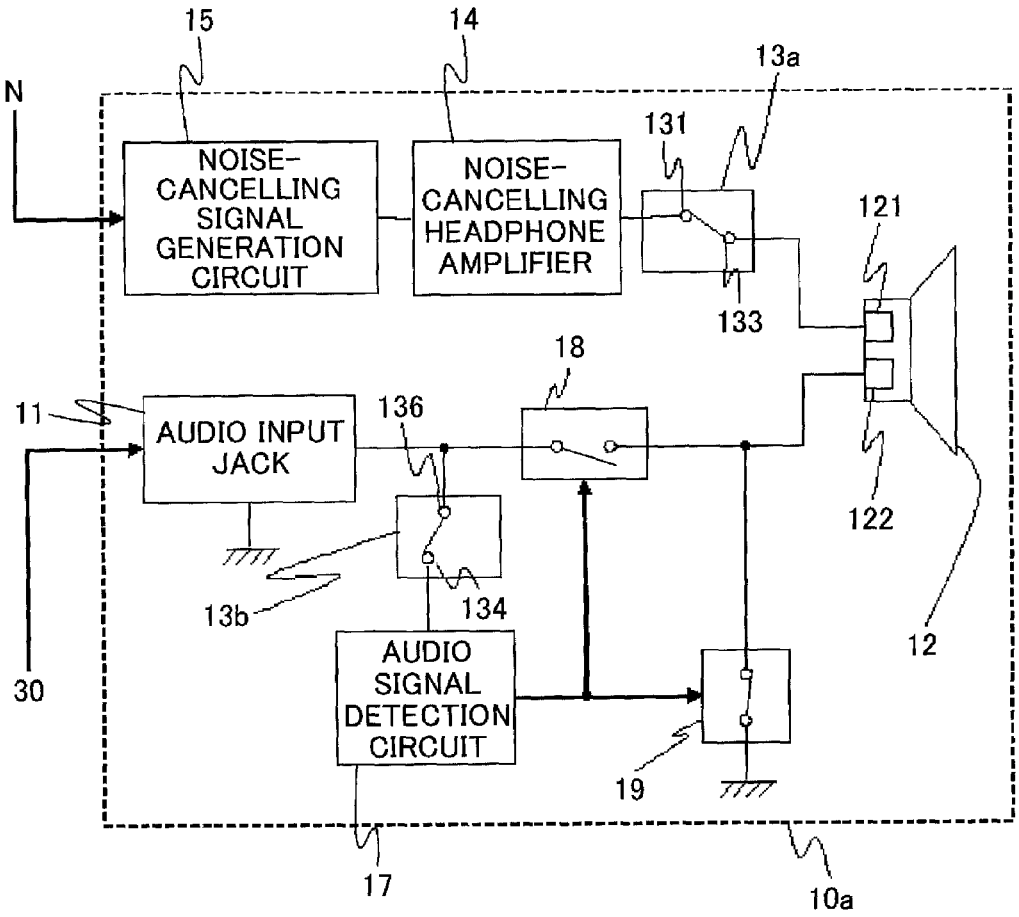
FIG. 8 is a block diagram showing an example of another operating state of the noise-cancelling circuit.

A state is shown in FIG. 8, where the movable contact 133 of the selector switch 13*a* is switched to the side of the fixed contact 131 from the operation aspect shown in FIG. 7 in order to activate the noise-cancelling function. Since the selector switch 13*b* works with the selector switch 13*a*, the movable contact 136 of the selector switch 13*b* switches to the side of the fixed contact 134 and the audio signal detection circuit 17 is connected to the sound source 30 via the audio input jack 11. When no audio signal is input from the sound source 30, the audio signal detection circuit 17 outputs no control signal and the electronic switch 18, being a make contact, remains open and the electronic switch 19, being a break contact, remains closed. Consequently, the second terminal 122 of the speaker unit 12 is grounded via the electronic switch 19 and to the first terminal 121, a cancel signal is input from the noise-cancelling headphone amplifier 14. The output impedance of the music reproducing headphone amplifier 31 on the side of the sound source 30 and the impedance of the terminal 121 to be grounded via the electronic switch 19 are substantially the same in magnitude, and therefore, even if the circuit connected to the terminal 122 is switched to another by the detection of the input of an audio signal by the audio signal detection circuit 17, the circuit remains electrically equivalent. Therefore, when no audio signal is input, the speaker unit 12 is driven only by a cancel signal and it can be made use of as a headphone dedicated to noise cancellation.

Figure 9:
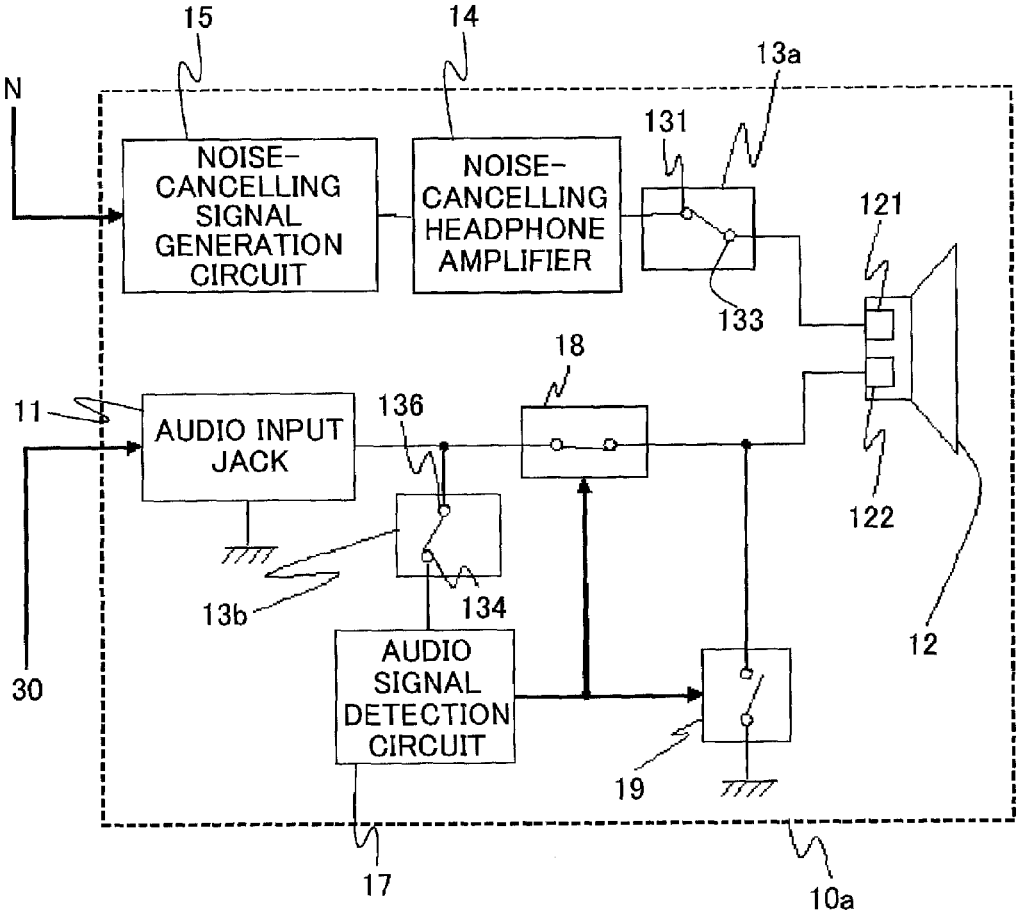
FIG. 9 is a block diagram showing an example of still another operating state of the noise-cancelling circuit.

A state where an audio signal is input in the embodiment described above is shown in FIG. 9. As already described, when detecting an audio signal, the audio signal detection circuit 17 outputs a control signal to the electronic switch 18 and the electronic switch 19. Consequently, when an audio signal is input from the sound source 30, the electronic switch 18 closes the contact and the electronic switch 19 is opened, and therefore, to the terminal 122, the audio input jack 11 is connected and unlikely to be grounded via the electronic switch 19. As a result, the noise-cancelling headphone amplifier 14 and the music reproducing headphone amplifier 31 of the sound source 30, as shown in FIGS. 2 and 3, operate like a BTL amplifier and drive the speaker unit 12. The speaker unit 12 outputs a reproduced sound based on the input signals of both the cancel signal and the audio signal.

As described above, according to the above-mentioned embodiment, it is possible for a user to arbitrarily select between a state where only a cancel signal is output and a state where an audio signal and a cancel signal are output together due to the two selector switches 13*a*, 13*b* that work with each other. Even when the sound source 30 is connected, if no audio signal is input, it is possible to output only a cancel signal. In addition, when an audio signal is input, it is possible to output an audio signal and a cancel signal together. In this manner, because switching of circuits depending on the presence/absence of an audio signal can be performed automatically, it is possible to prevent fluctuations in the electrical characteristics due to switching of circuits as well as improving the convenience, and thus to cause the high quality music reproduction and the effective noise cancellation to coexist.

Figure 10:
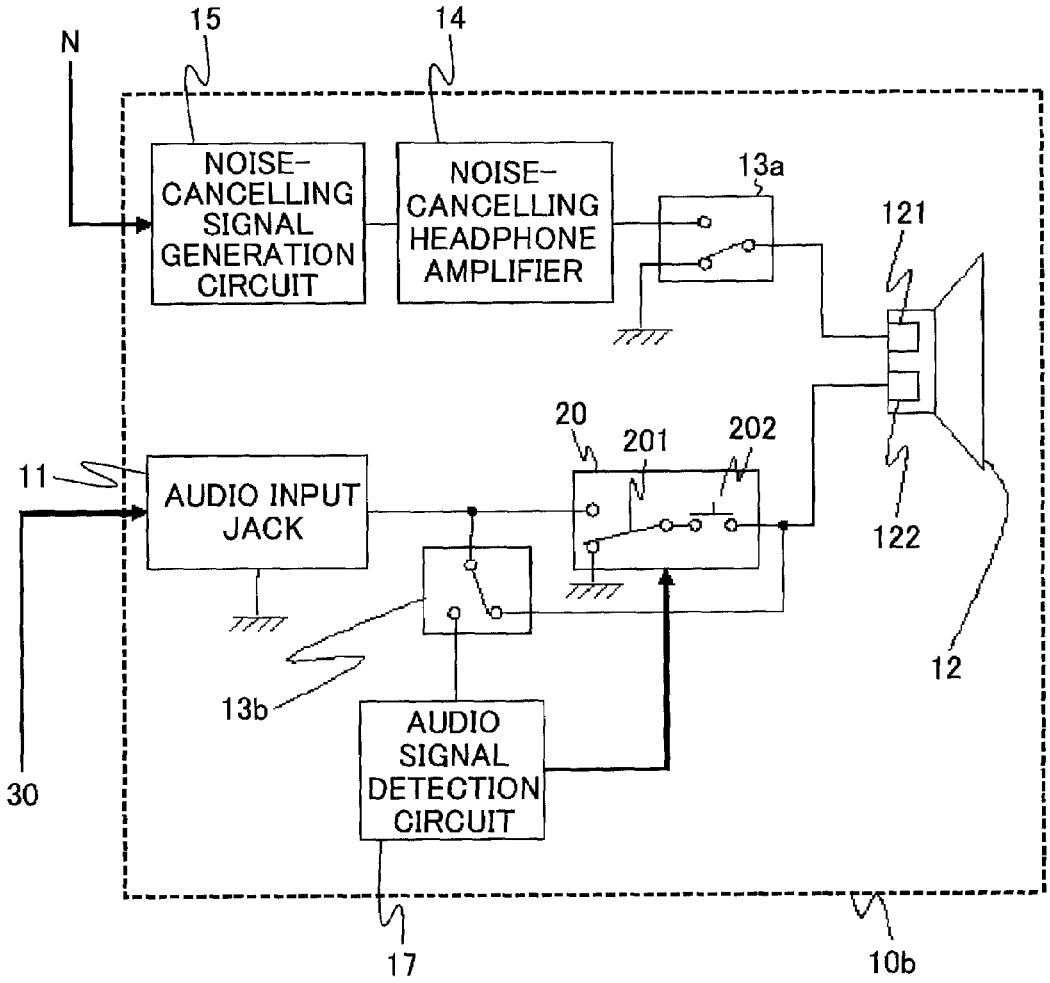
FIG. 10 is a block diagram showing still another example of a noise-cancelling circuit comprised by the noise-cancelling headphone according to the present invention.

Next, a still another embodiment of a headphone unit that can be used in the noise-cancelling headphone according to the present invention will be described using FIG. 10. A headphone unit 10*b* shown in FIG. 10 is an example in which the electronic switch 18 and the electronic switch 19 comprised by the headphone unit 10*a* in the embodiment shown in FIG. 6 are configured by one electronic selector switch 20. The same symbols are therefore used for the same constituent parts as those in the embodiment already described.

The electronic selector switch 20 of the headphone unit 10*b* is one which switches a movable contact 201 to the side of the fixed contact to which the audio input jack 11 is connected or to the ground side according to a control signal output from the audio signal detection circuit 17. Further, the electronic selector switch 20 has a switch contact 202 that turns on/off in cooperation with the movable contact of the selector switch 13*a*. The switch contact 202 breaks the contact between the movable contact 201 and the second terminal 122 of the speaker unit 12 when the movable contact of the selector switch 13*a* is on the ground side, that is, the power source of the headphone unit 10*b* is turned off.

When the headphone unit 10*b* is in a state where a cancel signal is input to the first terminal 121 of the speaker unit 12, that is, when the movable contact of the selector switch 13*a* is on the side of the noise-cancelling headphone amplifier 14, the movable contact of the selector switch 13*b* is on the side of the audio signal detection circuit 17 and the switch contact 202 is in a make state. In this state, if an audio signal is input from the sound source 30, the audio signal detection circuit 17 outputs a control signal to the electronic selector switch 20 and thereby the movable contact 201 is switched to the side of the audio input jack 11, and therefore, the audio signal is input to the second terminal 122 of the speaker unit 12. In addition, to the first terminal 121 of the speaker unit 12, a cancel signal is input, and therefore, the speaker unit 12 is driven by the audio signal and the cancel signal and outputs both signals mixedly.

When the audio signal detection circuit 17 does not detect an audio signal, because the movable contact 201 of the switch 20 is switched to the ground side, the terminal 122 is grounded and the speaker unit 12 is driven only by a cancel signal, as a result.

As described above, according to the noise-cancelling headphone of the present invention comprising the headphone unit 10*b*, it is possible to output both a high quality audio output and an effective cancel signal output by automatically switching circuit configurations depending on the presence/absence of an audio signal and preventing fluctuations in the electrical characteristics as well as improving the convenience for a user. Further it is possible to realize the noise-cancelling headphone that exhibits such an effect with a small number of parts.

Figure 11:
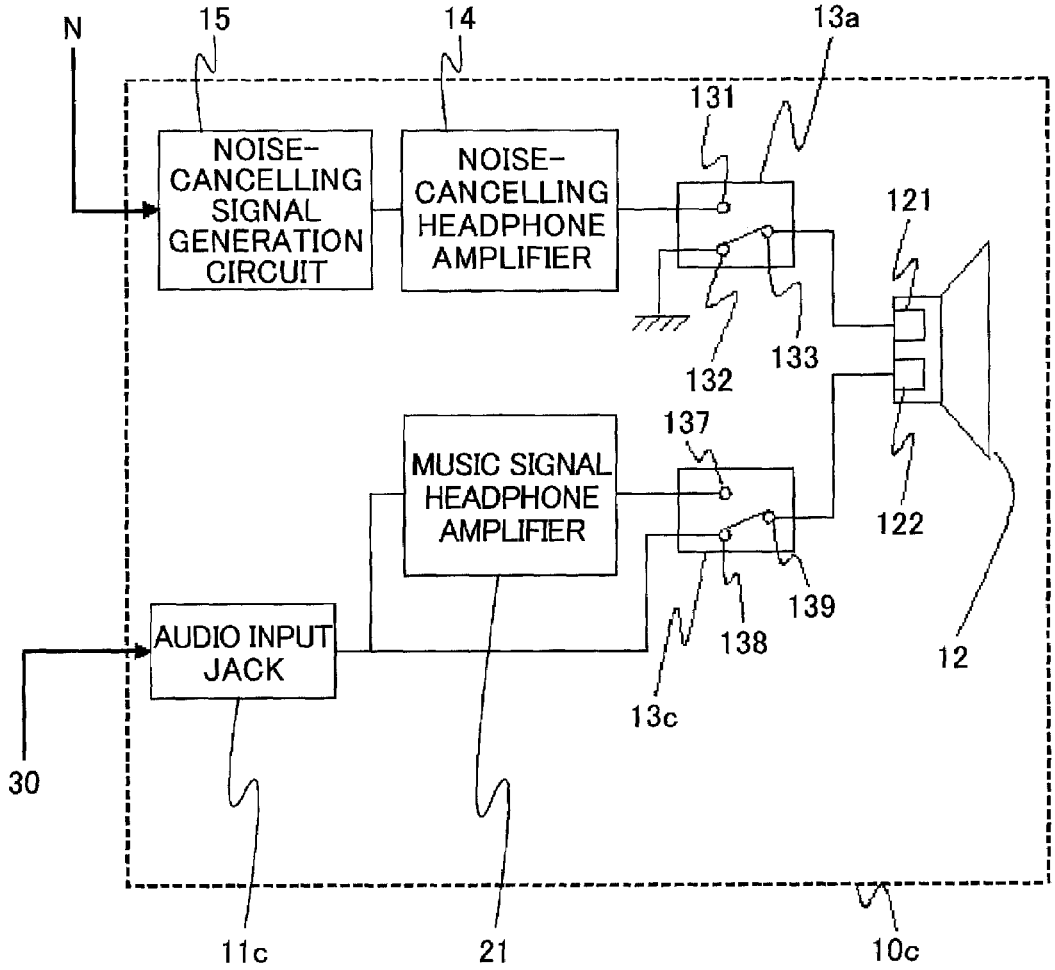
FIG. 11 is a block diagram showing still another example of a noise-cancelling circuit comprised by the noise-cancelling headphone according to the present invention.

Next, another embodiment of a headphone unit that can be used in the noise-cancelling headphone of the present invention will be described using a functional block diagram in FIG. 11. In FIG. 11, a headphone unit 10*c* has the speaker unit 12 having the first and second terminals 121, 122, the selector switch 13*a* that switches circuits to be connected to the first terminal 121 of the speaker unit 12, the noise-cancelling headphone amplifier 14 to be connected to the terminal 121 via the selector switch 13*a*, the noise-cancelling signal generation circuit 15 that generates and outputs a cancel signal based on the noise N picked up by a microphone unit, the selector switch 13*b* that switches circuits to be connected to the second terminal 122 of the speaker unit 12, an audio input jack 11*c* that connects the sound source 30, and an audio signal headphone amplifier 21, that outputs an audio signal input from the sound source 30 without amplifying it since the amplification degree of the audio signal amplifier is approximately 100%.

The selector switch 13*a* has the two fixed contacts 131, 132 and the movable contact 133, and the movable contact 133 is connected to the first terminal 121 of the speaker unit 12. To the first fixed contact 131 of the selector switch 13*a*, the output terminal of the noise-cancelling headphone amplifier 14 is connected and the second fixed contact 132 is grounded. The configuration is designed so that whether the noise-cancelling headphone amplifier 14 is connected to the first terminal 121 of the speaker unit 12 or the terminal 121 is grounded is selected by the selector switch 13*a*. The selector switch 13*a* may be one which can also be used as the power source switch of the noise-cancelling headphone and may further have a contact that switches connections between a drive power source, not shown, and each circuit. In the present embodiment, when the movable contact 133 of the selector switch 13*a* is on the side of the fixed contact 132, the power source switch of the noise-cancelling headphone is turned off.

In a selector switch 13*c*, a movable contact 139 is connected to the second terminal 122 of the speaker unit 12 and a first fixed contact 137 is connected to the output terminal of an audio signal headphone amplifier 21. A second fixed contact 138 of the selector switch 13*c* bypasses the audio signal headphone amplifier 21 and is connected to the audio input jack 11*c*. The selector switch 13*c* is a switch that works with the selector switch 13*a* and when the movable contact 133 of the selector switch 13*a* is on the side of the fixed contact 132, the movable contact 139 of the selector switch 13*c* is on the side of the fixed contact 138. When the movable contact 133 of the selector switch 13*a* is on the side of the fixed contact 131, the movable contact 139 of the selector switch 13*c* is on the side of the fixed contact 137.

When the movable contact 133 of the selector switch 13*a* is on the side of the fixed contact 131, a cancel signal is input to the first terminal 121 of the speaker unit 12. Further, the second terminal 122 of the speaker unit 12 is connected to the output terminal of the audio signal headphone amplifier 21 via the selector switch 13*c*.

When an audio signal is input from the sound source 30, the audio signal is input to the terminal 122 via the audio signal headphone amplifier 21 as a result. The amplification factor of the audio signal headphone amplifier 21 is about 1 and therefore the audio signal input from the sound source 30 is not amplified. When the movable contact 133 of the selector switch 13*a* is on the side of the fixed contact 131, it is possible to drive the speaker unit 12 independently by an audio signal and a cancel signal, respectively, like a BTL amplifier using the noise-cancelling headphone amplifier 14 and the audio signal headphone amplifier 21, and therefore, the music and the cancel sound can be output together. Due to this, the cancel signal reduces the noise N and it is possible to listen to the output of the audio signal with the same sound quality as that of the normal headphone.

Unlike the audio input jack 11 in the embodiment described above, the audio input jack 11*c* does not have a structure in which a signal line is grounded even when the sound source 30 is not connected. However, even when the sound source 30 is not connected to the audio input jack 11*c*, the output impedance of the audio signal headphone amplifier 21 exhibits the same effect as that when the second terminal 122 of the speaker unit 12 is grounded. Consequently, it is possible to drive the speaker unit 12 only by a cancel signal input to the first terminal 121 of the speaker unit 12 and it can be used as a headphone unit dedicated to noise cancellation, which outputs only a cancel signal.

In the present specification, the "audio signal" refers to a so-called audio signal in addition to a general audio signal, and is sometimes referred to as "musical sound signal".

What is claimed is:

1. A noise-cancelling headphone comprising:

an electro-acoustic transducer converting ambient noise into a noise signal;

a cancel signal generator generating and outputting a cancel signal to eliminate the noise from the noise signal; and a speaker unit outputting an audio signal and the cancel signal, wherein the cancel signal generator is connected to a first terminal of two input terminals of the speaker unit and a sound source of the audio signal is connected to a second terminal.

2. The noise-cancelling headphone according to claim 1, further comprising a first switching unit between the first terminal of the speaker unit and the cancel signal generator, wherein the first switching unit is capable of selecting either to connect the cancel signal generator to the first terminal or to ground the first terminal.

3. The noise-cancelling headphone according to claim 2, wherein the first switching unit is composed of a selector switch having a movable contact and a first fixed contact and a second fixed contact selected by the movable contact;

the movable contact is connected to the first terminal of the speaker unit;

the first fixed contact is connected to the cancel signal generator; and the second fixed contact is grounded.

4. The noise-cancelling headphone according to claim 1, further comprising a sound source input terminal that can be attached to/detached from the second terminal of the speaker unit, wherein the sound source input terminal is a terminal grounded at a signal line side contact thereof when an output terminal of the sound source is not inserted into the sound source input terminal.

5. The noise-cancelling headphone according to claim 1, wherein the second terminal of the speaker unit is grounded via a resistance element having an impedance larger than an output impedance of the sound source and smaller than an impedance of the speaker unit.

6. The noise-cancelling headphone according to claim 2, functioning as a normal headphone when a movable contact of a first selector switch is on the side of a second fixed contact.

7. The noise-cancelling headphone according to claim 4, outputting only the cancel signal from the speaker unit when the output terminal of the sound source is not inserted into the sound source input terminal.

8. The noise-cancelling headphone according to claim 1, further comprising:

an audio signal detector detecting the audio signal input from the sound source and outputting a control signal;

a second selector switch located between a sound source input terminal and the audio signal detector and working with a first selector switch;

a first electronic switch making a contact by the control signal of the audio signal detector; and a second electronic switch breaking a contact by the control signal of the audio signal detector, wherein a movable contact of the second selector switch is connected to the sound source input terminal, a first fixed contact is connected to the audio signal detector, and a second fixed contact bypasses the first electronic switch and is connected to the second terminal of the speaker unit; and the first electronic switch is connected to the sound source input terminal and the second terminal of the speaker unit, and the second electronic switch is connected between the second terminal of the speaker unit and the ground.

9. The noise-cancelling headphone according to claim 1, further comprising:

an audio signal detector detecting the audio signal input from the sound source and outputting a control signal;

a second selector switch located between a sound source input terminal and the audio signal detector and working with a first selector switch; and an electronic selector switch located between the second terminal of the speaker unit and the sound source input terminal and connecting the second terminal and the sound source input terminal when a movable contact of the first selector switch is on the side of a second fixed contact and the audio signal detector detects the audio signal.

10. The noise-cancelling headphone according to claim 8, configured such that when an armature of a first switching unit is connected to the first fixed contact, an armature of a second switching unit is connected to the first fixed contact and when the armature of the first switching unit is connected to the second fixed contact, the armature of the second switching unit is connected to the second fixed contact.

11. The noise-cancelling headphone according to claim 8, configured such that when the audio signal detector detects the audio signal, the first electronic switch makes a contact and the second electronic switch breaks a contact, and thereby the audio signal input from the sound source is input to the second terminal.

12. The noise-cancelling headphone according to claim 1, further comprising:

a sound source input terminal capable of attaching/detaching the sound source;

a headphone amplifier outputting the audio signal input from the sound source; and a third switching unit between the second terminal of the speaker unit and the headphone amplifier, and between the second terminal of the speaker unit and the sound source input terminal, wherein the third switching unit can select to connect to the second terminal of the speaker unit either the headphone amplifier or the sound source input terminal.

13. The noise-cancelling headphone according to claim 1, wherein the first terminal of the speaker unit is a positive terminal of the speaker unit; and the second terminal of the speaker unit is a negative terminal of the speaker unit.

14. The noise-cancelling headphone according to claim 1, wherein the first terminal of the speaker unit is a negative terminal of the speaker unit; and the second terminal of the speaker unit is a positive terminal of the speaker unit.

* * * * *